US010016999B2

(12) United States Patent
Parmar

(10) Patent No.: US 10,016,999 B2
(45) Date of Patent: Jul. 10, 2018

(54) MACHINE AND PROCESS FOR BINDING OF BOOKS FOR LAY FLAT LOOK

(71) Applicant: Nilesh Dhirajlal Parmar, Gujarat (IN)

(72) Inventor: Nilesh Dhirajlal Parmar, Gujarat (IN)

( * ) Notice: Subject to any disclaimer, the term of this patent is extended or adjusted under 35 U.S.C. 154(b) by 224 days.

(21) Appl. No.: 14/433,696

(22) PCT Filed: Nov. 23, 2012

(86) PCT No.: PCT/IN2012/000767
§ 371 (c)(1),
(2) Date: Apr. 6, 2015

(87) PCT Pub. No.: WO2014/057494
PCT Pub. Date: Apr. 17, 2014

(65) Prior Publication Data

US 2015/0273927 A1 Oct. 1, 2015

(30) Foreign Application Priority Data

Oct. 11, 2012 (IN) ..... 2997/MUM/2012

(51) Int. Cl.
*B42D 1/00* (2006.01)
*B42D 5/00* (2006.01)
(Continued)

(52) U.S. Cl.
CPC ..... *B42C 19/02* (2013.01); *B26D 9/00* (2013.01); *B26F 1/02* (2013.01); *B26F 1/38* (2013.01);
(Continued)

(58) Field of Classification Search
CPC .. B42C 19/02; B42C 5/00; B42D 1/08; B42D 1/005; B26D 9/00; B26F 1/02; B26F 1/38; B42B 4/00
(Continued)

(56) References Cited

U.S. PATENT DOCUMENTS 6,099,225 A 8/2000 Allen et al.
6,126,354 A * 10/2000 Ramich ..... B42F 13/165 281/21.1
(Continued)

FOREIGN PATENT DOCUMENTS

AU 2001100264 A4 9/2001
CA 2887422 A1 4/2014
(Continued)

OTHER PUBLICATIONS

"International Application No. PCT/IN2012/000767", "International Search Report", dated Jul. 25, 2013, Publisher: International Searching Authority / CN, Published in: CN.
(Continued)

*Primary Examiner* — Justin V Lewis
(74) *Attorney, Agent, or Firm* — Kaplan Breyer Schwarz, LLP

(57) ABSTRACT

A method of binding plurality of pages such that the pages lie flat when book is open which comprise of creating window cut or window slit on the page at a space parallel to the spine of book, die hole punching between the window slit and spine, accomplishing v shaped spine, and stapling between the die hole punching and window slit and a machine which has assembly to window cut, die hole punch and staple resulting in step binding.

9 Claims, 7 Drawing Sheets

(51) Int. Cl.

| | |
|---|---|
| ***B42C 9/00*** | (2006.01) |
| ***B42B 5/00*** | (2006.01) |
| ***B42C 19/02*** | (2006.01) |
| ***B26D 9/00*** | (2006.01) |
| ***B26F 1/02*** | (2006.01) |
| ***B26F 1/38*** | (2006.01) |
| ***B42B 4/00*** | (2006.01) |
| ***B42C 5/00*** | (2006.01) |
| ***B42D 1/08*** | (2006.01) |

(52) U.S. Cl.
CPC ..... *B42B 4/00* (2013.01); *B42C 5/00* (2013.01); *B42D 1/005* (2013.01); *B42D 1/08* (2013.01)

(58) Field of Classification Search
USPC ..... 281/3.1, 15.1; 412/1, 6, 7, 9, 33
See application file for complete search history.

(56) References Cited

U.S. PATENT DOCUMENTS

| | | | | |
|---|---|---|---|---|
| 6,708,967 | B1 * | 3/2004 | Trovinger ..... | B41F 17/02 412/16 |
| 7,762,542 | B2 | 7/2010 | Tagawa et al. | |
| 2005/0265809 | A1 * | 5/2005 | Lemens ..... | B42B 5/00 412/33 |
| 2008/0219802 | A1 | 9/2008 | Hata | |
| 2011/0101666 | A1 * | 5/2011 | Tamaki ..... | B42D 1/04 281/3.1 |

FOREIGN PATENT DOCUMENTS

| | | | |
|---|---|---|---|
| CN | 2189056 | Y | 2/1995 |
| CN | 102173253 | A | 7/2011 |
| CN | 201979835 | U | 9/2011 |
| DE | 202006019366 | U1 | 4/2007 |
| WO | 2016110789 | A1 | 7/2016 |

OTHER PUBLICATIONS

"International Application No. PCT/IN2012/000767", "ISA / CN", Jul. 25, 2013, Publisher: Written Opinion of the International Searching Authority, Published in: CN.

Authorized Officer: Shane Thomas, "International Search Report and Written Opinion" issued in related PCT application No. PCT/IB2016/050002, dated Jul. 4, 2016, Publisher: PCT.

* cited by examiner

MACHINE AND PROCESS FOR BINDING OF BOOKS FOR LAY FLAT LOOK

FIELD OF THE INVENTION

The present invention relates to method whereby prints or paper undergo process of window cutting, punching and stapling resulting in step binding and machine thereof. This process gives the bound book a lay flat look when opened. The machine enables the process of window cutting, punching and stapling in the same machine.

BACKGROUND OF THE INVENTION

Photo albums, books and magazines are bound in a manner where multiple pages are held together in a book block. These multiple sheets of papers or folded papers are held together by different methods which includes sewing, saddle wire stitching, stapling, spiral binding, velo bind, plastic comb binding, perfect binding. In the case of spiral binding, velo binding, plastic comb binding and perfect binding the binding is accomplished with a hard plastic or metal wire holding the plurality of sheets together at the spine. In the case of plurality of paper which are sewn together the book is subjected to a binding process wherein the spine of the stitched block is attached to a hard cover using glue or other treatment.

The conventional method for the binding of plurality of pages with double sided prints is done manually with little technical assistance of the binding machine wherein the prints are stapled manually and when the book is opened a slight radius in the middle of two prints is present. This hampers the vision in the print detail, as the print cannot be viewed properly at the point of radius. The plurality of pages when bound together by stapling, sewing or perfect binding causes the pages to be held firmly together at the spine which causes the book to form an arcuate configuration near the spine when opened resulting in difficulty in viewing the text or picture adjacent to the spine. At times prints are made away from the spine so that its view of images is not obstructed on opening of the book which results in reduction of printable area. The reader is further required to exert additional force on the page in the direction of spine to extend the page outward to view such text or image which could damage the binding or result in tearing of pages. This causes difficulty in reading and could lead to loss of valuable information and durability of the book.

In manual binding the prints are stapled manually which results in lack of perfection and the book cannot open flat resulting in lack of full view of book, photograph or album.

Therefore it has become necessary to develop a method which would give the books a lay flat look when open and are also firmly held at the spine.

Therefore it has become necessary to develop machines which would give the books a lay flat look when open and which are cheap and can be installed easily.

Accordingly, an object of the present invention is to provide for a method which would give the books a lay flat look when open and are also firmly bound at the spine.

It is an object of the present invention to provide for machine which would give the books a lay flat look when open and are firmly bound at the spine.

It is an object of the present invention to provide for method and machine and apparatus which are economical and easy to use, giving a product which has high visible quotient, durability, accuracy and finesse in binding and of superior quality.

SUMMARY OF THE INVENTION

The present invention provides for method to bind the book in a manner such that the book gives a lay flat look when open and a machine for accomplishing the said process. The process could be applied to a variety of documents including albums, catalogue, photographs and papers.

The pages are introduced to a window cutting process wherein spaced rectangular slits are opened parallel to the spine of the bundled pages at regular intervals. The slits are made at a predetermined space from the spine end of the page such that there is sufficient space for stapling and binding.

The pages, if they form part of a photo album, catalogue or such can undergo the process of thermal lamination in a separate machine through know known methods and machine.

The pages are introduced to a punching assembly in the machine whereby holes are created at a predetermined interval in the space between the window cutting slit and the spine such that there is sufficient space for the stapling process. The holes are punched in a manner such that for the first half of the plurality of pages the holes are punched with a regular reducing distance from the spine. For the second half of the plurality of the pages the holes are punched in a manner which is at an regular increasing distance from the spine to the last page of first half which results in V shaped spine such that the pages at the centre of the book form the lower tip of v and the pages at the ends form upper two tips of v. The pages are then introduced to the stapling assembly wherein the pages get aligned with a pin and firmly attached by stapling. The plurality of pages is transported from one assembly to the other manually. The book is then trimmed at the edges, cover affixed by know processes and ready for use with a lay flat look.

According to one aspect, the present subject matter provides a method of binding a plurality of pages comprising: window-cutting a slit on each page of the plurality of pages; punching a hole on each page of a plurality of pages at a predetermined interval in a manner such that for a first half of the plurality of pages the holes are punched on each page of the plurality of pages, wherein relatively adjacent pages of the plurality of pages have holes punched at a successively reducing distance from a spine and for a second half of the plurality of the pages the holes are punched on each page of plurality of pages, wherein relatively adjacent pages of the plurality of pages have holes punched at a successively increasing distance from the spine resulting in a V-shaped spine and stapling the plurality of pages in a manner such that a book is obtained with a flat layout, wherein the V-shaped spine is obtained by aligning the holes of the plurality of pages. In one embodiment, stapling includes aligning the plurality of pages using a vertical pin through the holes. In a second embodiment, the method comprises laminating each page of the plurality of page.

According to a second aspect, the subject matter provides a machine for binding a plurality of pages comprising: a window-cutting assembly configured to cut a window-slit on each page of the plurality of pages; a punching assembly configured to punch a hole on each page of the plurality of pages; a control panel configured to control the punching assembly, wherein the punching assembly is configured to punch holes at a predetermined interval in a manner such that for a first half of the plurality of pages the holes are punched on each page of the plurality of pages, wherein relatively adjacent pages of the plurality of pages have holes punched at a successively reducing distance from a spine and for a second half of the plurality of the pages the holes are punched on each page of the plurality of pages, wherein relatively adjacent pages of the plurality of pages have holes punched at a successively increasing distance from the spine resulting in a V-shaped spine, wherein the V-shaped spine is obtained by aligning the holes of the plurality of pages. According to one embodiment, the punching assembly comprises a punching die, a pair of punching guide ways, a pedal switch, a stepper motor and a guide; wherein the guide ways and the guide are adjustable according to dimensions of a page of the plurality of pages and location of hole on the page; wherein the guide is configured to position the page move and stops to position the page for forming holes and the stepper motor is configured to move the guide and the pedal switch is configured to cause falling of the punching die to cause a hole. According to a second embodiment, the machine further comprises a stapling assembly to staple the plurality of pages having a stapler to staple the plurality of pages, a pneumatic lever for sliding the stapler, and a vertical pin to align the plurality of pages through the holes. In a third embodiment, the control panel controls the punching assembly depending on length of a page of the plurality of pages, number of pages, distance between spine and hole of a first page and a last page of the plurality of pages, number of pages to move in a forward direction and number of pages to move in reverse direction to form the V-shaped spine. In a fourth embodiment, the window-cutting assembly comprises a window-cutting die; a pair of guide ways and a guide; wherein the guide ways and guide are adjustable according to dimensions of a page of the plurality of pages and location of the window-slit relative to the spine to position the page of the plurality of pages to form a window-slit and the window-cutting die forms the window-slit on the page.

According to a third aspect, the present subject matter provides a book comprising: a plurality of pages, each page of the plurality of pages having a window-slit and holes; wherein the holes on each page of a plurality of pages is at a predetermined interval in a manner such that for a first half of the plurality of pages the holes are punched on each page of the plurality of pages, wherein relatively adjacent pages of the plurality of pages have holes punched at a successively reducing distance from a spine and a second half of the plurality of the pages the holes are punched on each page of the plurality of pages, wherein relatively adjacent pages of the plurality of pages have holes punched at a successively increasing distance from the spine resulting in a V-shaped spine such that the book obtains with a flat layout upon opening, wherein the V-shaped spine is obtained by aligning the holes of the plurality of pages.

BRIEF DESCRIPTION OF DRAWINGS

A full understanding of the invention can be gained from the following description of the preferred embodiments when read in conjunction with the accompanying drawings in which.

DETAILED DESCRIPTION

Figure 1:
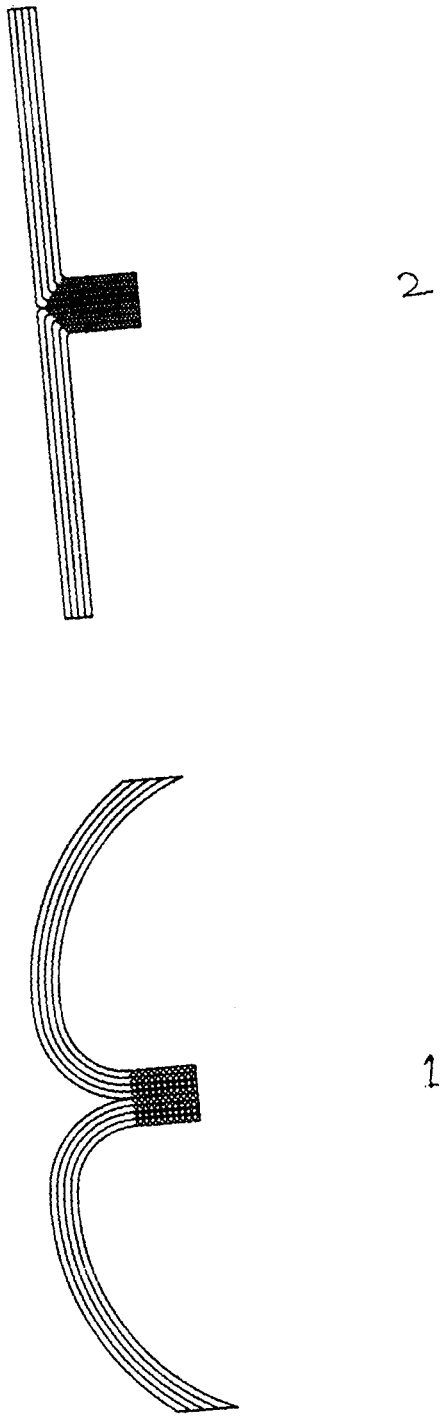
FIG. 1 shows a book which is made in the conventional manner or other forms of binding in which an arcuate configuration is formed closer to the spine and a book which has a lay flat look.

For the purposes of illustrations, embodiments of the invention will be described as forming different assembly in the same machine, although it will become apparent that each assembly could be a separate installation detached from each other. Numerous specific details are set forth in order to provide a thorough understanding of the invention. While the invention has been described in conjunction with the specific embodiments outlined herein, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein. However, it will be understood by those of ordinary skill in the art that the invention may be practiced without these specific details. In other instances, well-known methods, procedures or/or components have not been described in detail so as not to obscure the invention. Reference will now be made in detail to the preferred embodiments of the present invention, an example of which is illustrated in the accompanying drawings.

Directional phrases used herein, such as, for example, left, right, top, bottom, upper, lower, side, back, inner, outer and derivatives thereof, relate to the orientation of the elements shown in the drawings and are not limiting upon the claims unless expressly recited therein.

FIG. 1 shows a book 1 which is made as per the conventional method of binding or other known process manually or in a mechanized manner. The book forms an arcuate configuration adjacent to spine reducing the readability of contents closer to the spine. In photo prints it will result in damage to the print if opened many times. FIG. 1 shows a book 2 which is made as per the process and machine described in the present invention in which the book gives a lay flat look when open. It clearly increases the readability of the contents closer to the spine in addition to other benefits.

Figure 2:
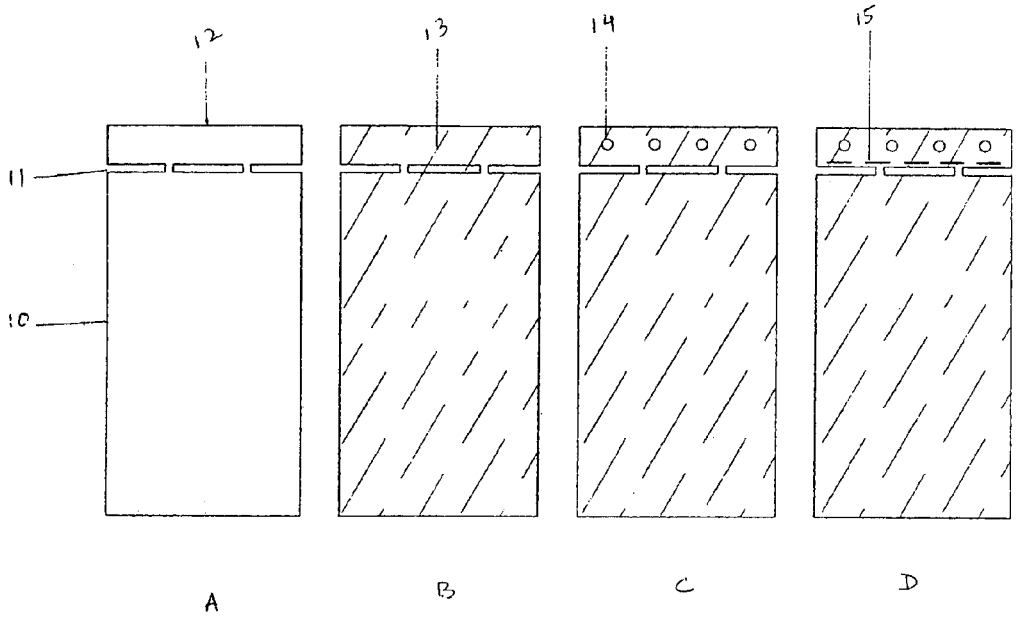
FIG. 2 shows the 4 stage process in which a sheet of paper undergoes transformation during the four stages of window cutting, lamination, die punching and stapling.

FIG. 2 shows the steps in which the paper or a photo print undergoes change at each stage by following the process as per the present invention. A shows paper or photo print 10 with window cutting or window slits 11 on the edge of the paper, having marginal area with the help of a die, leaving enough space at the end of paper facing the spine 12 for stapling. Window cutting is done on the edge of the photo prints, so as to give more flexibility during the movement of prints, book or album during the process.

B shows paper 10, when a photo prints, is exposed to thermal lamination to increase strength of the photo prints, on both sides of photo prints, in a separate machine. The thermal film 13 enables easy movement and flexibility of the photo prints or paper and increases its durability.

C shows paper 10 after lamination 13 undergoes die hole punching 14 at a space betweenthe spine 12 of the page and window slit 11. After the window cutting process and lamination the paper becomes heavier and unwieldy than earlier resulting in difficulty in arranging and matching the window cutting or slits of the paper in one line and level which is achieved by diehole punching 14, in which a die cause holes to be punched on the papers at a predetermined spacing on the prints in a forward and reverse action and vice-versa. This can be achieved manually or through a method. The die punching 14 processes can be regulated with a digital control panel. The machine process in a manner that the load of multiple pages gets balanced and load keeps on shifting to the other pages. In an embodiment of the machine for carrying out the process, a digital program also achieves the purpose in a seamless manner. The operator is required to enter the number of pages with different parameters including the length of the page, distance required from the spine 12 to the window cutting, die punching and stapling. This process results in the giving a finesse at edges with the window cutting 11.

D shows paper 10 after the process of die punching 14 undergoes the process of stapling 15 at space between the spine 12 and window cutting 11. This is the last step of the present invention. The book or album is affixed with a cover and is ready to use.

Figure 3:
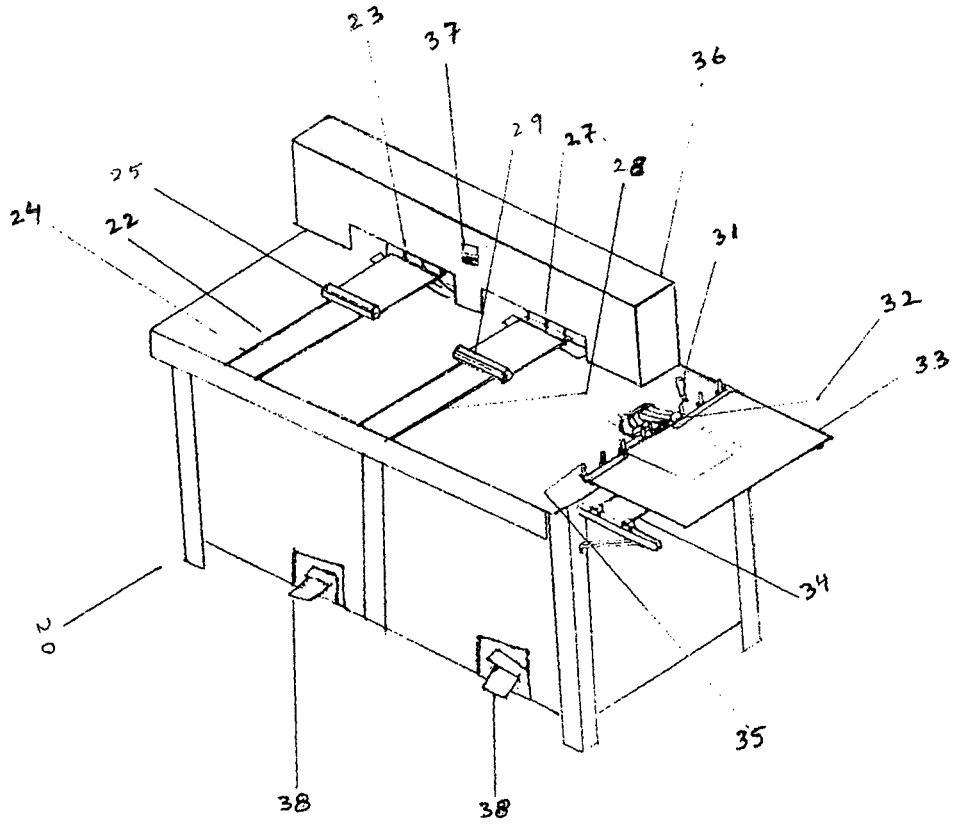
FIG. 3 shows the machine which has three different assemblies to carry out the steps of window cutting, die punching and stapling.

FIG. 3 shows a machine which could be a pneumatically operated machine 20 to accomplish the process of this invention which comprise of an exterior body 21. A window cutting assembly 22, to carry out window slits 11 on paper 10, comprises of a window cutting die 23, pair of setting guide ways 24 and guide 25. Setting guide ways 24 and guide 25 are adjusted according to the size of paper 10 and desired distance for window cutting from the spine such that paper moves in the direction of the window cutting die 23 such that the window slit is formed on the edge of the paper in addition to the other portion. The stepper motor in the machine 20 is connected with the linear ball screw, and this ball screw is fixed in a frame inside the machine, a nut is attached in the screw. When the stepper motor is initiated, the ball screw starts to rotate in its fixed position which causes the nut, which is fixed in the screw, move in a forward and reverse direction. The guide 25 is connected to the nut. The guide 25 moves and stops at the desired distance from the die 23 causing slit to be made at the desired distance from the spine 12.

Die hole punching assembly 26 carries out the process of hole punching 14 in paper 10 comprises of a punching die 27, pair of setting guide ways 28 and guide 29. The setting guide ways 28 and guide 29 are adjusted according to the size of paper 10 and desired distance for hole punching from the spine such that paper moves in the direction of the punching die such that the hole punching is formed at the predetermined level between the spine 12 of page 10 and the window slit 11. In the machine 20 the stepper motor is connected with the linear ball screw, and this ball screw is fixed in a frame inside the machine, a nut is attached in the screw. When the stepper motor is initiated, the ball screw starts to rotate in its fixed position only which causes the nut, which is fixed in the screw, to move in a forward and reverse direction. The guide 29 is connected to the nut. The guide 29 moves and stops at the desired distance from the die 27 causing holes to be punched at the desired distance from the spine 12.

The holes are punched in a manner such that for the first half of the plurality of pages the holes are punched with a regular reducing distance from the spine. For the second half of the plurality of the pages the holes are punched in a manner which is at an regular increasing distance from the spine to the last page of first half which results in V shaped spine such that the pages at the centre of the book form the lower tip of v and the pages at the ends form upper two tips of v. This is achieved by moving guide 29 in the forward and reverse direction for each half.

An assembly of stapling 30 comprise of a pneumatic lever 31 for sliding stapler 32 adjacent to a stapler 32 into which the paper 10 is placed, a base sliding table 33 which has a guide way 34 to adjust according to the size of paper 10. The vertical pin 35 aligns the plurality of pages 10. The base tray is slided in sideways from left to right which sets the stapling position. The stapler 32 moves forward and backward with lever 31. The stapler 32 moves forward when the plurality of pages get stapled which then moves backward in the tray.

The guard 36 houses the window cutting assembly and die hole punching assembly. The digital control panel 37 controls the function of assembly of window cutting 22, die punching 26 and stapling 30. The control panel receives instructions from the operator and the machines functions such that:

(i) Window cutting length is set depending on the length of page 10.

(ii) Set number of pages.

(iii) Set the distance between spine 12 and hole punching 14 for first page (iv) Set the difference of distance for hole punching 14 from spine 12 between current page 10 and last page preferably at 0.25 mm (v) Set the number of pages to move in a forward direction and the remaining pages to move in reverse direction such that it forms a v shape at the spine 12, preferably at half of the plurality of pages.

(vi) Set the number of page to cause Guide 29 to change direction of shift for increasing distance between hole punching and spine.

Pedal Switch 38 causes the window cutting die to fall on the base plate and hole punching die to fall on the plate causing the slit and holes.

Figure 4:
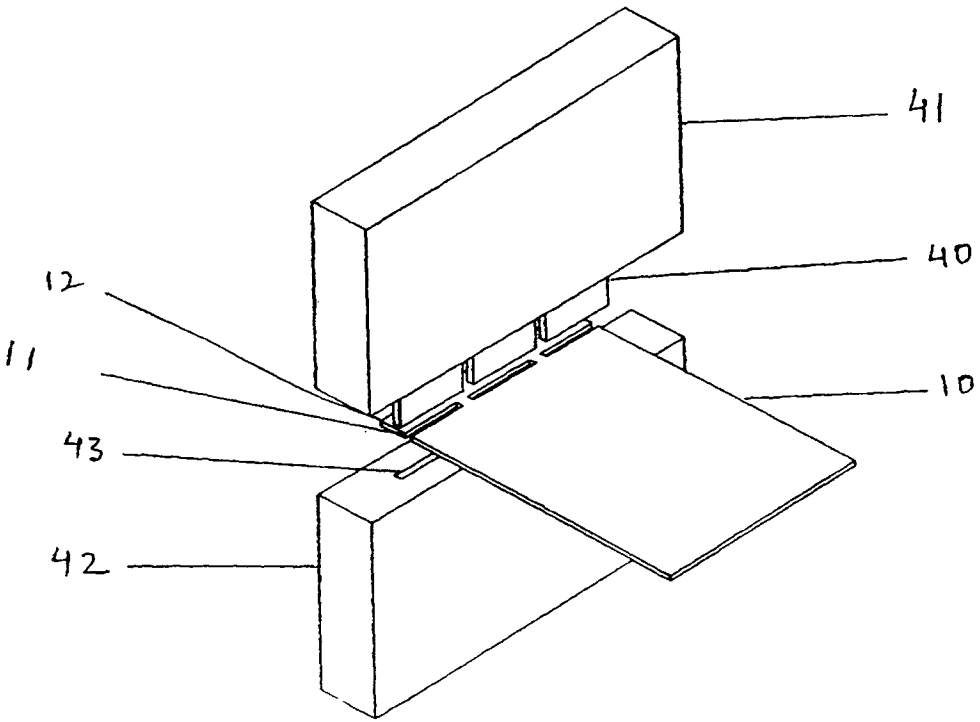
FIG. 4 shows the fragmentary view of assembly in which window cutting is carried out.

FIG. 4 the fragmentary view of window cutting die 23 which cuts the window slits. Cutting blade 40 housed in the cutting blade holder 41 which is further housed in guard 36. A base plate 42 opposite the cutting blade 40 contains recess 43 such that it receives the cutting blade 40 when pressed against it. Paper 10 when placed on base plate 42 and pressed with cutting blade 40 causes the window slit 11 parallel to spine 12.

Figure 5:
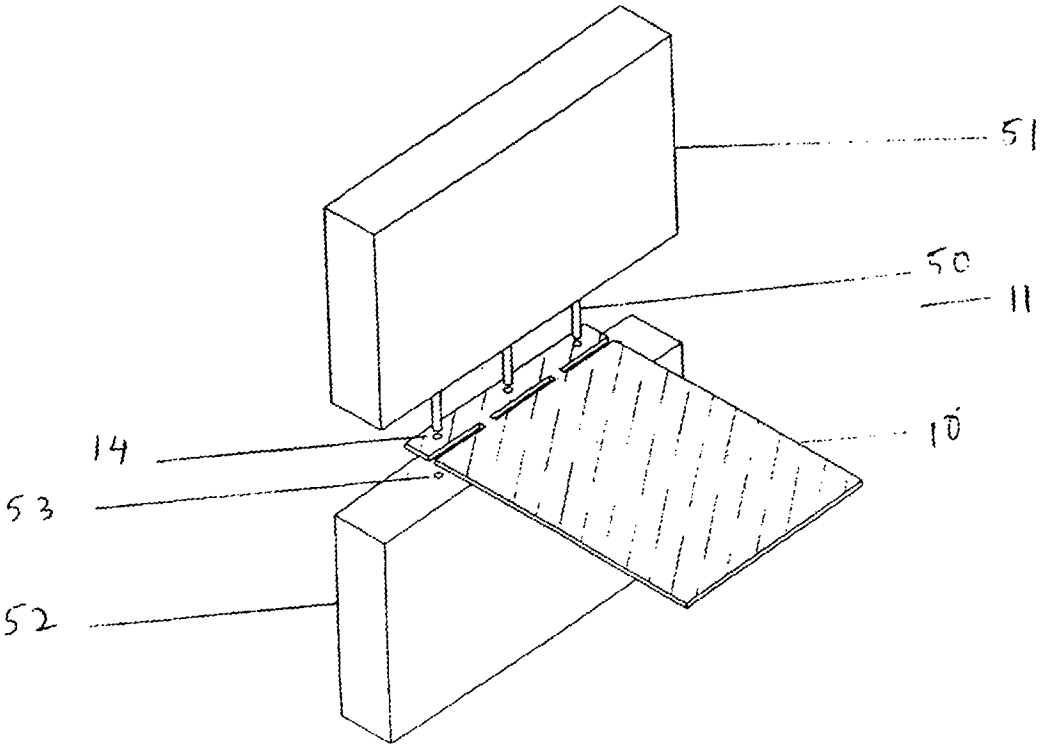
FIG. 5 shows the fragmentary view of assembly of machine in which die punching is carried out.

FIG. 5 is the fragmentary view of punching die 27 assembly which causes the punching holes 14. Punch 50 housed in the punch holder 51 which is further housed in guard 36. A punching base plate 52 opposite the punch 50 contains recess 53 such that it receives the punch 50 when pressed against it. Paper 10 when placed on base plate 52 and pressed with punch 50 causes the holes 14 at a space between the window slit 11 and spine 12.

Figure 6:
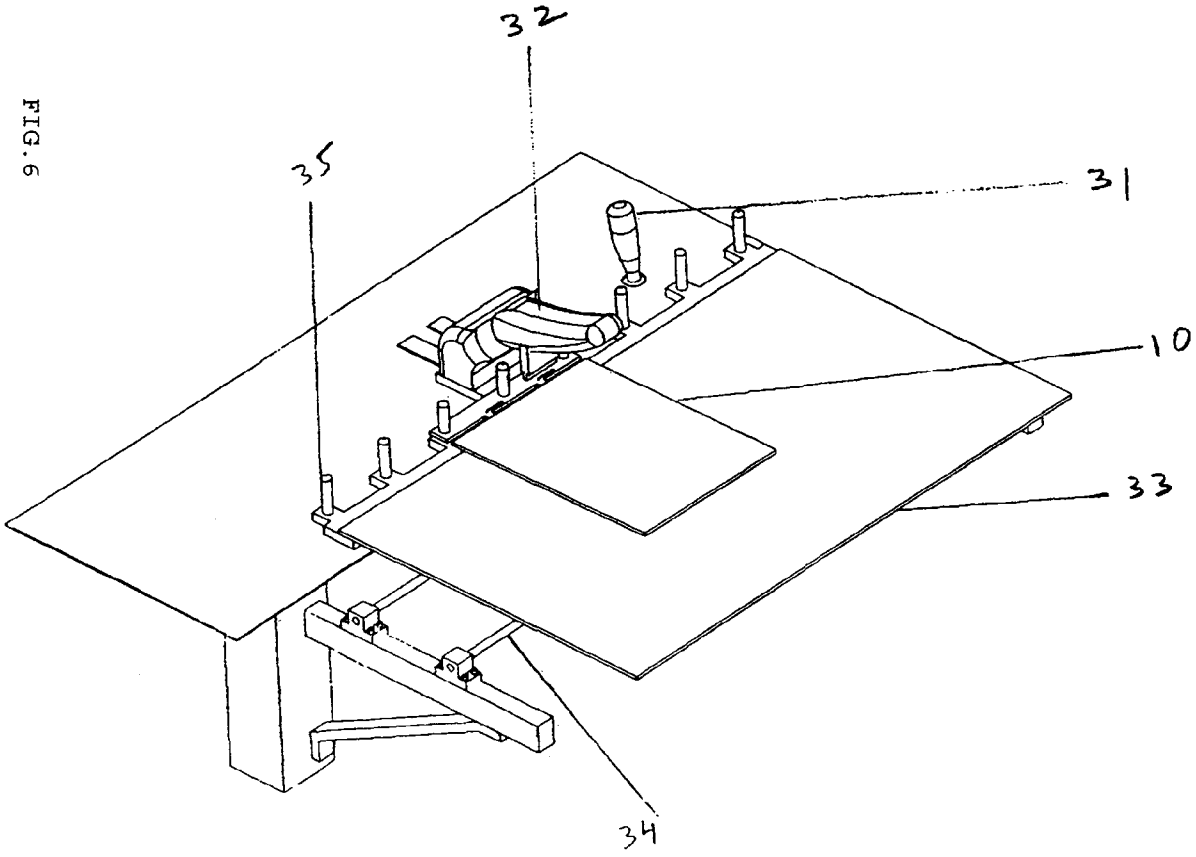
FIG. 6 shows the fragmentary view of assembly in which stapling is carried out.

FIG. 6 is the fragmentary view of assembly of stapling 30 which shows the process of stapling, of the plurality of page 10 which are stapled, with the control at Pneumatic Lever 31 for sliding stapler 32 which moves forward and reverse on the guide way 34 provided for the stapler. Base sliding table 33 which has a guide way 34 to move sideways while stapling. The vertical pin 35 aligns the plurality of pages 10 during the stapling process. Thus a step binding is accomplished from the plurality of pages. This causes the plurality of papers to bind in step binding forming a V shape as discussed in FIG. 7.

Figure 7:
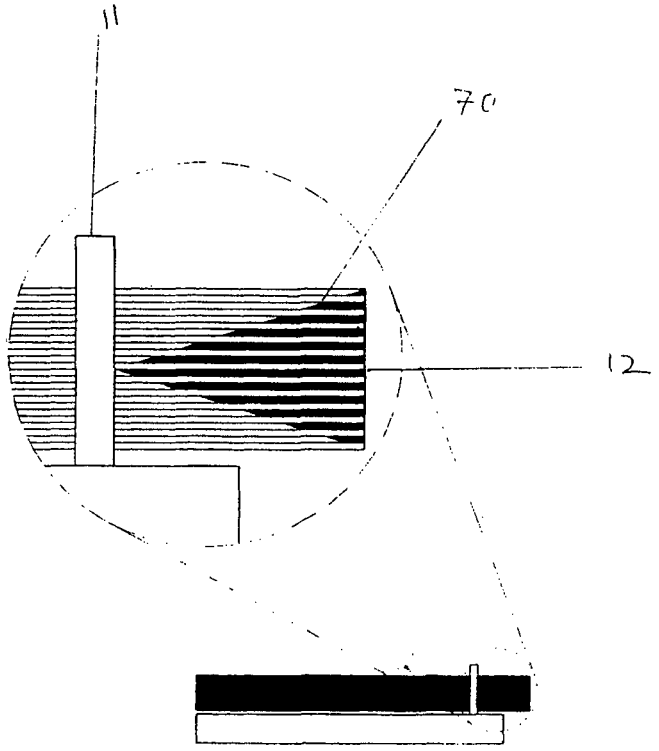
FIG. 7 shows the fragmentary view of the v shaped spine.

FIG. 7 illustrates, the cross sectional view of the bound papers, after the process of window cutting, die hole punching and stapling resulting in step binding. Step binding is the v shaped 70 spine formed. This gives the book a fully lay flat look when open as all the pages are fully aligned when open.

What is claimed is:

1. A method of binding a plurality of pages comprising: window-cutting a slit on each page of the plurality of pages; punching a hole on each page of a plurality of pages at a predetermined interval in a manner such that for a first half of the plurality of pages the holes are punched on each page of the plurality of pages, wherein relatively adjacent pages of the plurality of pages have the holes punched at a successively reducing distance from spines of the pages and for a second half of the plurality of the pages the holes are punched on each page of plurality of pages, wherein relatively adjacent pages of the plurality of pages have the holes punched at a successively increasing distance from the spines of the pages; aligning the holes of the plurality of pages with a pin to form a V-shaped spine; and stapling the plurality of pages in a manner such that a book is obtained with a flat layout.

2. The method of claim 1, wherein stapling includes aligning the plurality of pages using a vertical pin through the holes.

3. The method of claim 1, wherein the method comprises laminating each page of the plurality of pages.

4. A machine for binding a plurality of pages comprising: a window-cutting assembly configured to cut a window-slit on each page of the plurality of pages; a punching assembly configured to punch a hole on each page of the plurality of pages; a stepper motor; and a control panel configured to control the punching assembly, wherein the stepper motor moves and stops a guide that positions each of the plurality of pages relative to the punching assembly so that the punching assembly punches holes at a predetermined interval in a manner such that for a first half of the plurality of pages the holes are punched on each page of the plurality of pages, wherein relatively adjacent pages of the plurality of pages have the holes punched at a successively reducing distance from a spines of the pages and for a second half of the plurality of the pages the holes are punched on each page of the plurality of pages, wherein relatively adjacent pages of the plurality of pages have the holes punched at a successively increasing distance from the spines of the pages resulting in a V-shaped spine when the holes of the plurality of pages are aligned.

5. The machine of claim 4, wherein the punching assembly comprises a punching die, a pair of punching guide ways, and a pedal switch; wherein the guide ways and the guide are adjustable according to dimensions of each page of the plurality of pages and a location of the hole on the page; wherein the pedal switch is configured to cause falling of the punching die to cause the holes.

6. The machine of claim 4, further comprising a stapling assembly to staple the plurality of pages having a stapler to staple the plurality of pages, a pneumatic lever for sliding the stapler, and a vertical pin to align the plurality of pages through the holes.

7. The machine of claim 4, wherein the control panel controls the punching assembly depending on length of a page of the plurality of pages, number of pages, distance between spine and hole of a first page and a last page of the plurality of pages, number of pages to move in a forward direction and number of pages to move in reverse direction to form the V-shaped spine.

8. The machine of claim 4, wherein the window-cutting assembly comprises a window-cutting die; a pair of guide ways and a guide; herein the guide ways and guide are adjustable according to dimensions of a page of the plurality of pages and location of the window-slit relative to the spine to position the page of the plurality of pages to form a window-slit and the window-cutting die forms the window-slit on the page.

9. A book comprising: a plurality of pages, each page of the plurality of pages having a window-slit and holes; and a V-shaped spine, wherein the holes on each page of a plurality of pages are at a predetermined interval in a manner such that for a first half of the plurality of pages the holes are punched on each page of the plurality of pages, wherein relatively adjacent pages of the plurality of pages have the holes punched at a successively reducing distance from spines of the pages and a second half of the plurality of the pages the holes are punched on each page of the plurality of pages, wherein relatively adjacent pages of the plurality of pages have the holes punched at a successively increasing distance from spines of the pages, wherein the holes of the plurality of pages are aligned with one another thereby forming the V-shaped spine such that the book obtains with a flat layout upon opening.

* * * * *